US005888001A

United States Patent [19]

Sheng

[11] Patent Number: 5,888,001

[45] Date of Patent: Mar. 30, 1999

[54] PAPER TRAY FOR INK JET PRINTER

[75] Inventor: Thomas Sheng, Hsin-Chu, Taiwan

[73] Assignee: Avision, Inc., Hsin-Chu, Taiwan

[21] Appl. No.: 88,448

[22] Filed: Jun. 1, 1998

[51] Int. Cl.[6] ..... B41J 13/10

[52] U.S. Cl. ..... 400/646; 271/207

[58] Field of Search ..... 400/646, 625; 347/102, 104; 271/208, 207, 209, 188, 220; 101/416.1, 420

[56] References Cited

U.S. PATENT DOCUMENTS 5,648,807 7/1997 Saito et al. ..... 400/625

*Primary Examiner*—Edgar Burr

*Assistant Examiner*—Charles H. Nolan

*Attorney, Agent, or Firm*—H. C. Lin, Patent Agent

[57] ABSTRACT

The collecting tray of a ink-jet printer is equipped with a guard to prevent the paper immediately after exiting from the printer to fall to the bottom of the tray. The guard is much narrower than the width of the tray so that the guard tilts the paper. A succeeding sheet of paper pushes the tilted paper until the tilted paper is pushed beyond the end of the guard and falls to the bottom of the tray after a time delay for the ink to dry.

7 Claims, 9 Drawing Sheets

PAPER TRAY FOR INK JET PRINTER

BACKGROUND OF THE INVENTION

This invention relates to printers, in particular to paper trays of ink jet printers. In a convention ink jet printer, the output does not have a baking equipment to dry the printed ink for the sake of reduced cost and small size. As a result, if the drying speed of the ink on the output paper is slow, or if the solid area of a printed picture content is large, the following outputting paper may rub against the preceding paper to smear the undried printing.

SUMMARY

An object of this invention is to prevent smearing of printing on a preceding page due to rubbing of the paper due to a following page. Another object of this invention is a to provide a longer drying time of the ink on a printed paper.

These objects are achieved by using a guard at the exit of the printer to prevent the first sheet of paper from falling to the bottom of the tray when the paper first exits from the printer. The guard also causes a tilt of the first sheet. The following second sheet of paper pushes the tilted paper beyond the end of the guard and fell the first sheet to the bottom of the tray, thus delaying the time for the first sheet to fall to the bottom,

DETAILED DESCRIPTION OF THE PREFERRED EMBODIMENTS

Figure 1:
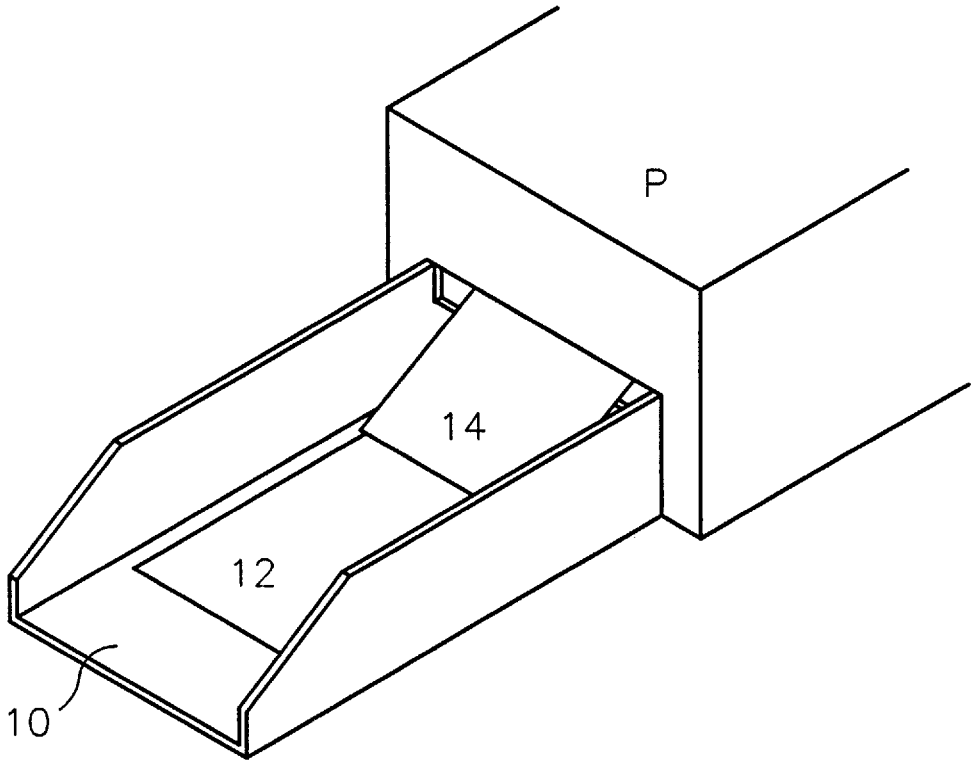
FIG. 1 shows a prior art technique for collecting printed papers of a printer.

FIG. 1 shows the conventional way which a tray collects printed pages from a ink jet printer. A printer P output papers which are collected in a tray 10. The figure shows a sheet of paper 12 has already been collected by the tray 10 and a second sheet of paper 14 is being outputted from the printer P. If the ink printed on paper 12 not yet dried when the leading edge of paper 14 rubs paper 12, the printing on paper 12 can be smeared and paper may have to be discarded. A customary method to solve this problem is to wait for the first sheet of paper 12 to dry before the second sheet is fed, or to take away each printed page from being contacted by the next printed page. Such a procedure wastes time and labor.

Figure 2A:
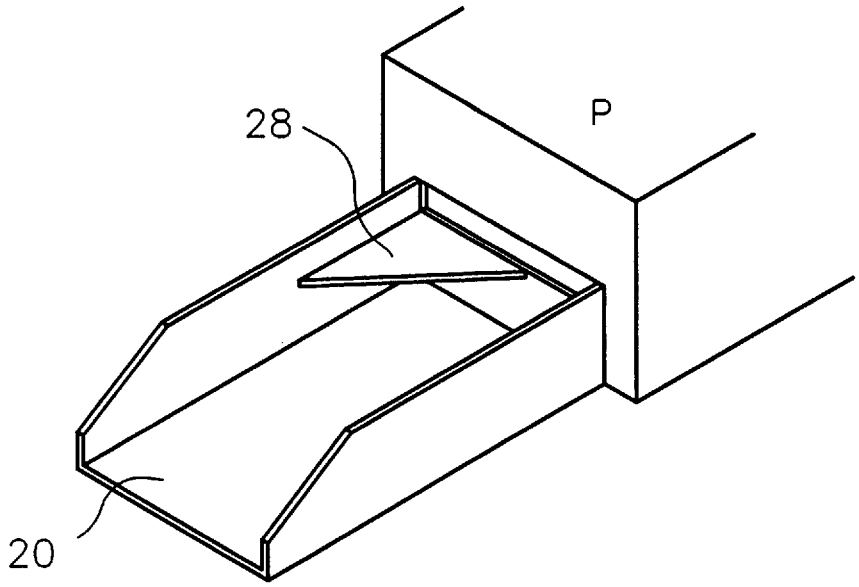
FIG. 2A shows the structure of a tray for collecting printed paper based on the present invention.
Figure 2B:
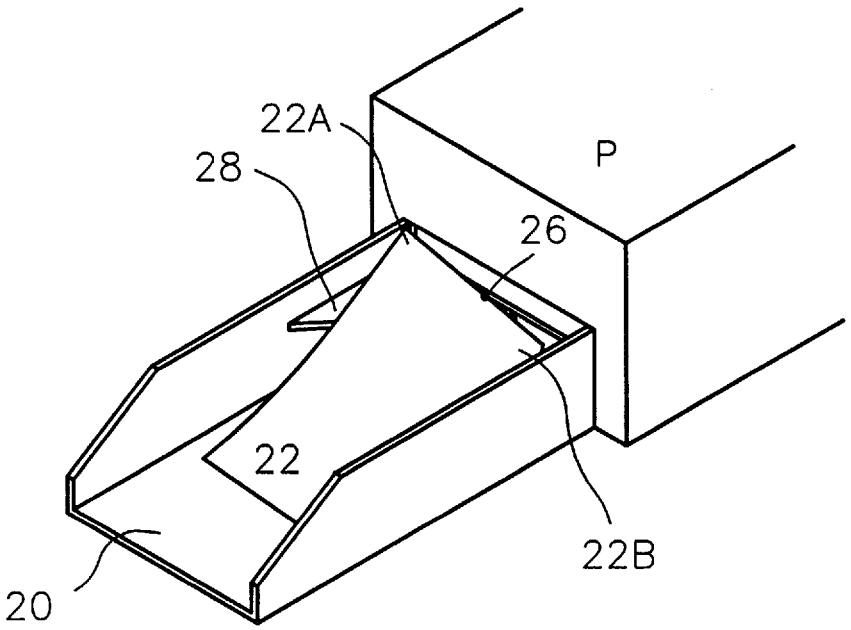
FIG. 2B and FIG. 2C show the sequence of action for a first printed page to fall into the tray.
Figure 2C:
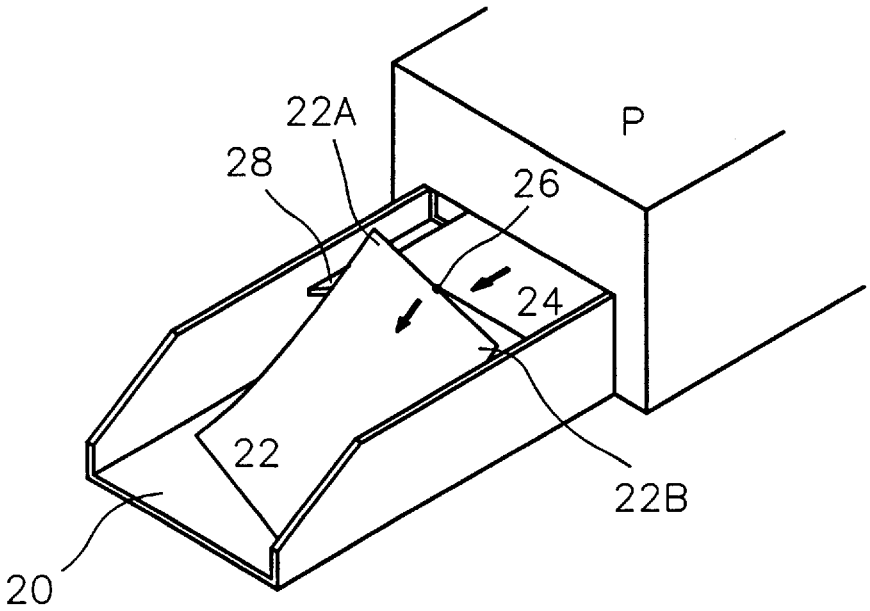
Figure 2D:
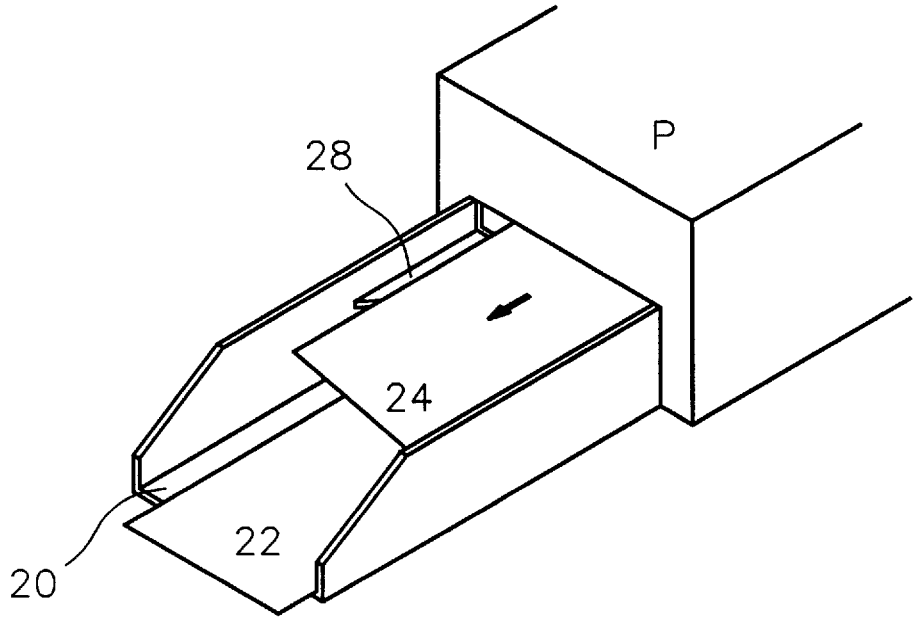
FIG. 2D and FIG. 2E show the sequence of action for a second printed page to fall into the tray.
Figure 2E:
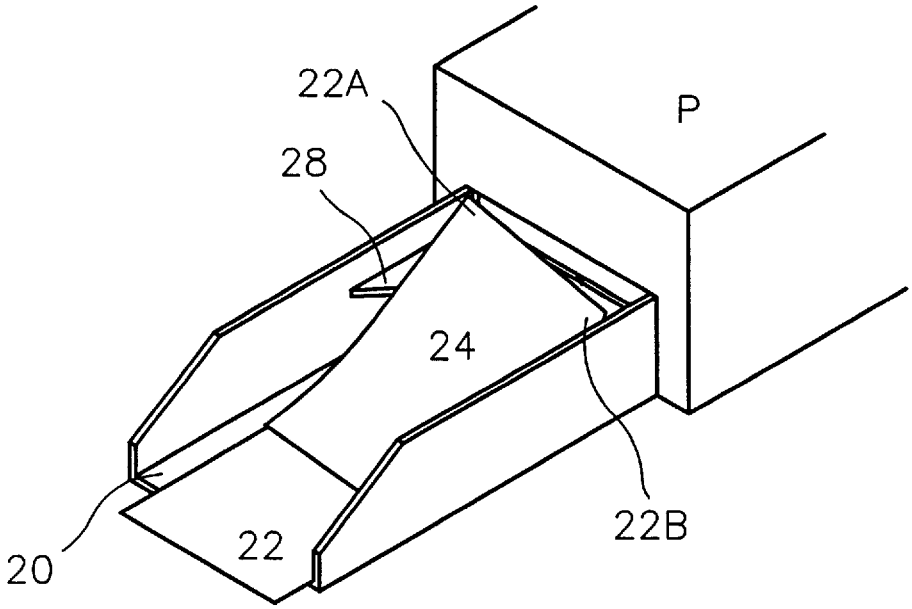

FIG. 2A shows a first embodiment of the present invention. At the corner of the tray close to the printer P and near the top of the tray is a guard 28. FIGS. 2B to FIG. 2E shows the process how a printed sheet 22 drops into the tray. At first as shown in FIG. 2B, the guard 28 prevents the leading portion of the printed sheet from free falling to the tray, and causes a corner 22A of the trailing edge of the paper to rise. As the paper 22 advances further as shown in FIG. 2C, the trailing edge contacts the guard 28 and is tilted to be pushed at a point 26 by a second sheet of paper 24. FIG. 2D shows that the paper 22 has been pushed by sheet 24 away from the guard 28, and has fallen into the tray 20. FIG. 2E shows how the second sheet 24 being is delayed by the guard 28 to rub against the first sheet 22. When the second sheet 24 has completely left the printer, the trailing edge of paper 24 is tilted and ready to be pushed by a next sheet of printed paper.

Figure 2F:
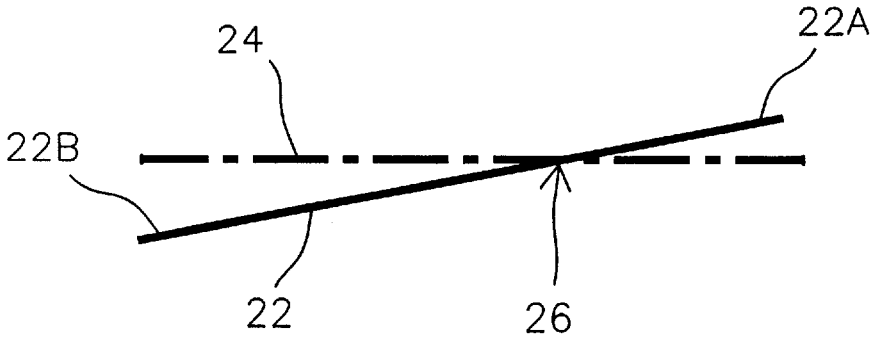
FIG. 2F shows the tilt angle of a printed paper falling into the tray.

FIG. 2F shows the side view of the sheet of paper shown in FIG. 2A as viewed from the printer P. The right hand corner 22A of the paper 22 is tilted up by the guard, and the left-hand corner 22B of the paper is pushed down. The second sheet of paper 24 pushes the first sheet 22 to leave the guard 28 and fall into the tray 20.

Figure 3A:
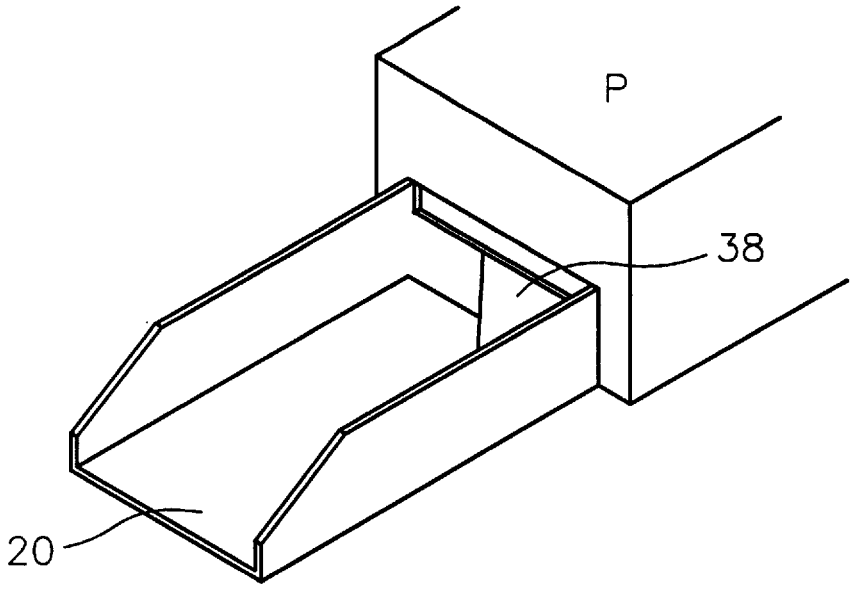
FIG. 3A shows a second embodiment of the collecting tray.
Figure 3B:
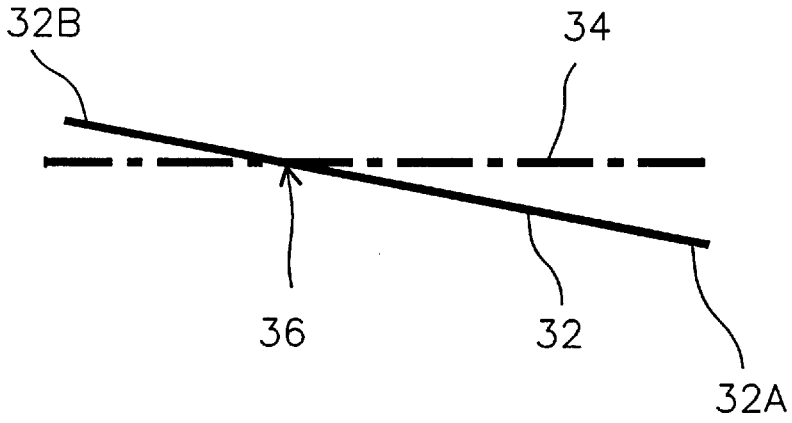
FIG. 3B shows the side view of the falling paper.

FIG. 3A shows a modification of the first embodiment, in which the guard 38 is located at the upper left-hand corner of the tray 20 near the printer P The operation is the same as FIGS. 2A–2F. As the paper 32 is fed from the printer P, the left-hand corner 32B of the trailing edge of the printed paper is tilted upward and the right-hand corner 32A is tilted downward as shown in FIG. 3B. The next paper 34 pushes the tilted paper 32 at point 36 until the paper 32 falls into the tray 20.

Figure 4A:
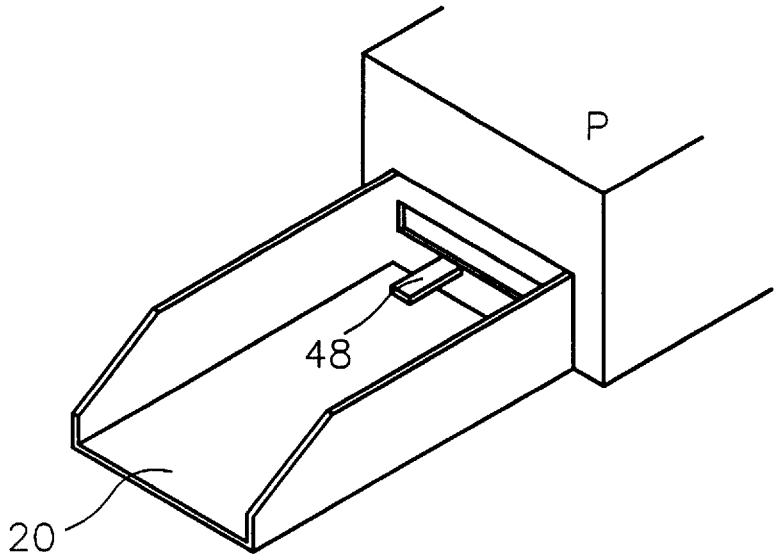
FIG. 4A shows a third embodiment of the present invention.
Figure 4B:
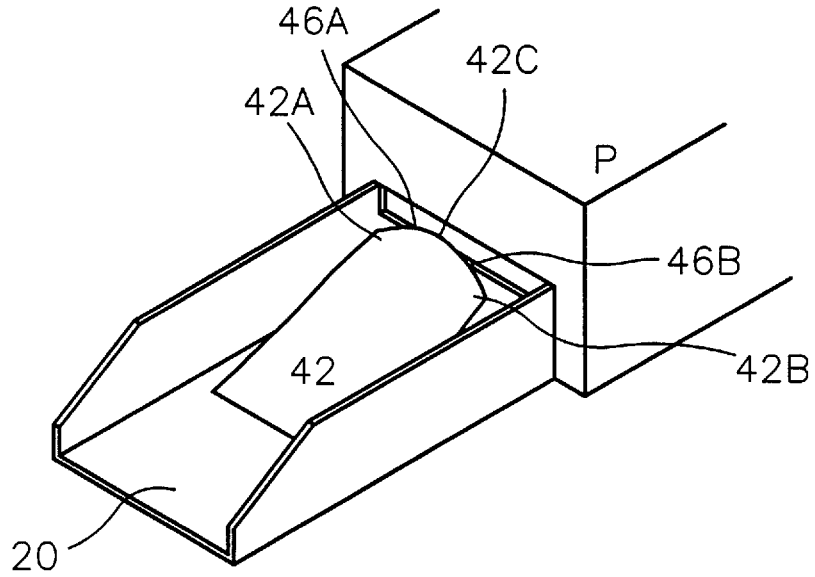
FIG. 4B shows the printed paper fed from a printer.

FIG. 4A shows another design of the present invention. A guard 48 is placed at the center of the inside wall of the tray 20 near the output end of the printer P. The guard tilts the middle section 42C of the printed paper 42 upward and droops the two ends 42A and 42B downward to form an arc as shown in FIG.3B. The points 46A and 46B are where the next sheet of paper 44 pushes the first sheet of paper 42 to fall into the tray.

Figure 4C:
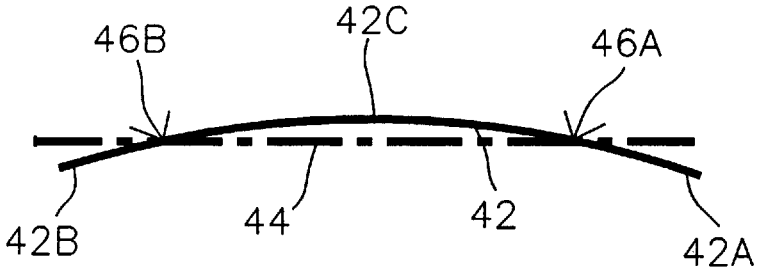
FIG. 4C shows a side view of the printed paper.

FIG. 4C shows end view of the printed paper as viewed from the printer. The center section 42C of the paper 42 is pushed upward and the two sides 42A and 42B droop downward. When the second sheet 44 of printed paper contacts the first sheet 42 at points 46A and 46B, the first sheet 42 is pushed forward until sheet 42 leaves the guard and fall into the tray 20.

Figure 5A:
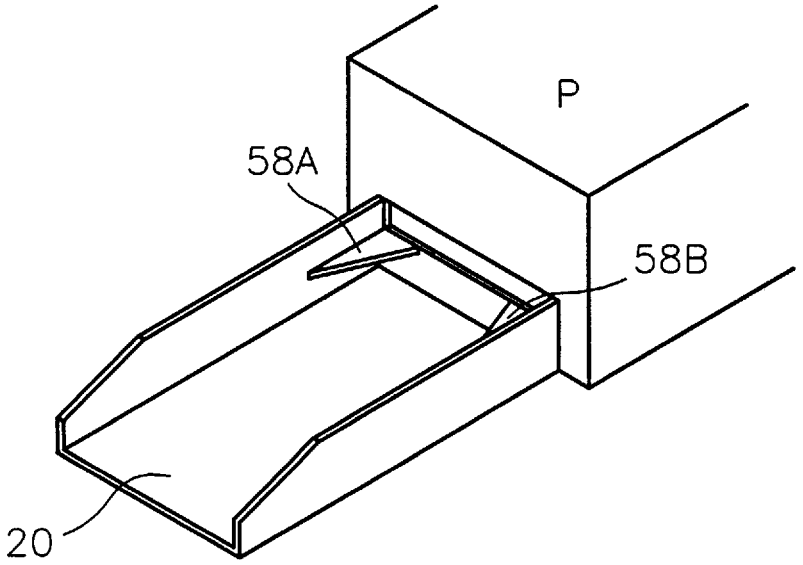
FIG. 5A shows a fourth embodiment of the tray.
Figure 5B:
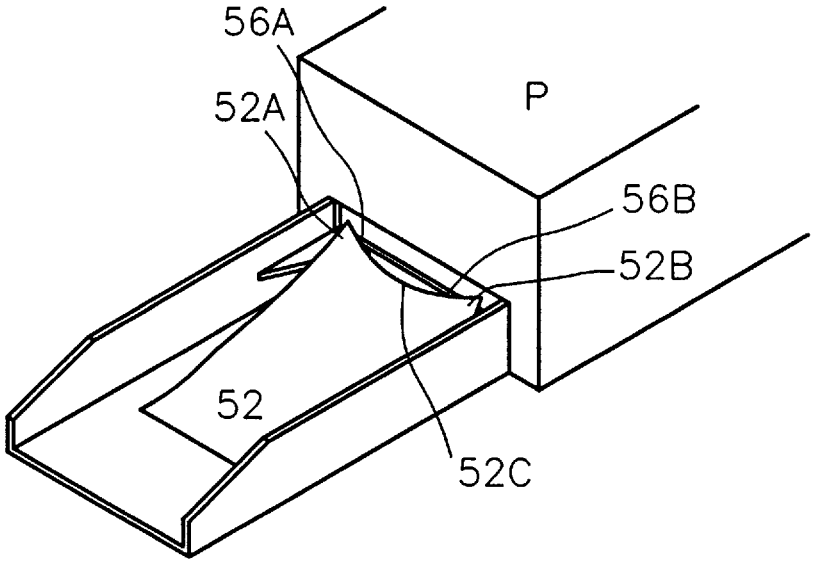
FIG. 5B shows the falling paper.

FIG. 5A shows a fourth design of the present invention. Two guards 58A and 58B are placed at two corners of the tray next to the printer ink jet printer P. These two guards tilt the two ends 52A and 52B of the paper upward and sags the middle section 52C of the paper downward as shown in FIG. 5B.

Figure 5C:
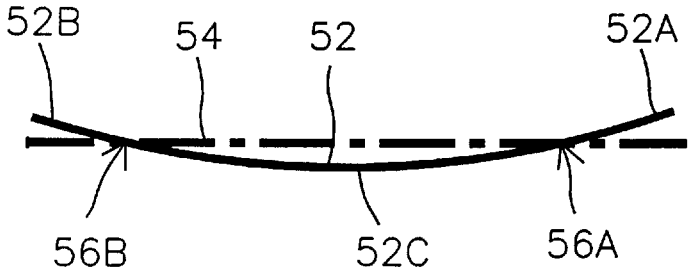
FIG. 5C shows the cross-section view of the falling paper.

FIG. 5C shows the end view of the paper as seen from the printer. The two corners 52A and 52B of the first sheet of paper 52 are tilted upward and the center section 52C sags downward. The second sheet of printed paper 54 contact the first sheet 52 at point 56A and 56B and push the sheet 52 forward until the sheet 52 leaves the guards 58A and 58B, and falls into the tray 20.

Figure 6:
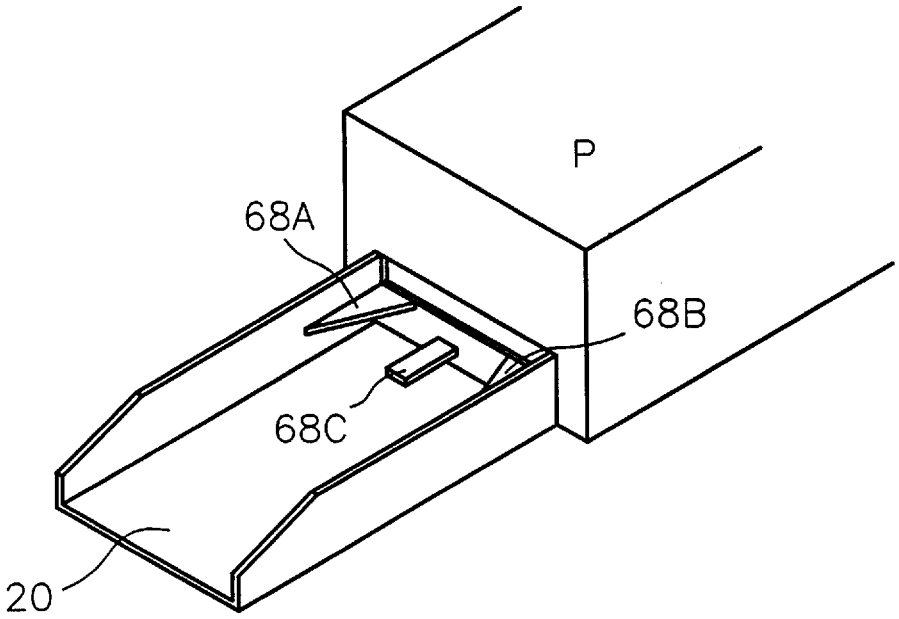
FIG. 6 shows a sixth embodiment of the tray.

FIG. 6 shows another embodiment of the tray 20. In addition to the two corner guards 68A and 68B near the printer P, a center support 68C is placed lower than the corner guards 68A and 68B. As the comer guards tilt the two ends of the printed paper upward, the center portion of the paper sags by gravity, but is supported by the support 68C.

In the foregoing description, a tray is used to collect the printed paper. It should be understood that the printed paper can also be dispersed on the table on which the printer rests. In that case, the table serves as the collecting tray.

While the preferred embodiments of the invention have been shown and described, it will be apparent to those skilled in this art that various modification may be made in the embodiments without departing from the spirit of the present invention. Such modifications are all within the scope of this invention.

What is claimed is:

1. A paper collecting system for printed papers from an ink jet printer, comprising:

a tray placed at the output end of said printer;

guard means positioned in said tray consisting of at least one guard shorter than the length of said tray, mounted on an inside wall of the said tray close to said output end, elevated from the bottom of said tray, said guard means being the only structure contacting said printed paper between the time that said paper leaves the output end of said printer and the time when said paper comes to rest in said tray, said guard causing a first sheet of paper outputting from said printer to bend by gravity force and preventing said first sheet from falling to the bottom of said tray until a second sheet of paper outputting from said printer pushes said first outside the end of said tray.

2. A paper collecting system as described in claim 1, wherein said guard is located at a first corner of said tray, causing said first sheet to tilt upward at said corner and to sag at the corner opposite to said first corner, and be pushed by said second sheet at the trailing edge of said first sheet.

3. A paper collecting system as described in claim 2, wherein said guard has s a triangular shape with the base of the triangular shape closer to said printer.

4. A paper collecting system as described in claim 1, wherein said guard is located at a center of said inside wall, causing said first sheet to sag at two sides and be pushed by said second sheet at two points somewhere between said center and said two ends.

5. A paper collecting system as described in claim 1, wherein there are two of said guard, each located at two inner corners of said inside wall, causing said first sheet to tilt upward at the two corners and to sag at the center of said first sheet, and be pushed by said second sheet at two points somewhere between said center and said two sends.

6. A paper collecting system as described in claim 5, further comprising a support located at a center of said inside wall and below the elevation of said guard.

7. A paper collecting system for printed papers from an ink jet printer, comprising:

a surface below said printer, guard means mounted on a frame of the printer, and elevated from and parallel to said surface, said guard means being the only structure contacting said printed paper between the time that said paper leaves the output of said printer and the time when said paper comes to rest at said surface, said guard means causing a first sheet of paper outputting from said printer to bend by gravity force and preventing said first sheet from falling surface until a second sheet of paper outputting from said printer pushes said first sheet outside the end pf said guard.

* * * * *